US005567116A

United States Patent [19]

Bourcier

[11] Patent Number: 5,567,116

[45] Date of Patent: Oct. 22, 1996

[54] ARRANGEMENT FOR CLIPPING STRESS PEAKS IN A TURBINE BLADE ROOT

[75] Inventor: Pierre Bourcier, Paris, France

[73] Assignee: GEC Alsthom Electromecanique SA, Paris, France

[21] Appl. No.: 532,103

[22] Filed: Sep. 22, 1995

[30] Foreign Application Priority Data

Sep. 30, 1994 [FR] France ..... 94 11724

[51] Int. Cl.[6] ..... F01D 5/30

[52] U.S. Cl. ..... 416/219 R

[58] Field of Search ..... 416/219 R, 223 A, 416/248

[56] References Cited

U.S. PATENT DOCUMENTS

| | | | |
|---|---|---|---|
| 5,110,262 | 5/1992 | Evans | 416/219 R |
| 5,141,401 | 8/1992 | Juenger et al. | 416/219 R |

FOREIGN PATENT DOCUMENTS

| | | | |
|---|---|---|---|
| 677142 | 8/1952 | United Kingdom | 416/219 R |
| 1482308 | 8/1977 | United Kingdom . | |
| 2064667 | 6/1981 | United Kingdom . | |
| 2271817 | 4/1994 | United Kingdom . | |

*Primary Examiner*—James Larson

*Attorney, Agent, or Firm*—Sughrue, Mion, Zinn, Macpeak & Seas

[57] ABSTRACT

An arrangement for clipping stress peaks in the anchoring of a turbine blade including a root that is shaped like a Christmas tree, that includes tangs, and that is received in a correspondingly-shaped groove in a disk so as to anchor the blade thereto, wherein the outline of each tang, on the extrados side of the blade root, is such that the clearance for mounting the root in its groove, on the extrados side, is not uniform but rather it includes at least one zone in which the clearance varies, the zone corresponding to a zone of the tang in question where, if the disk-and-blade assembly were rotating at its rated speed of rotation, there would otherwise occur a stress peak relative to the mean stress along the tang if the blade were mounted with constant clearance along the entire length of the tang, the varying clearance varying along the at least one zone with the same sign as the stress peak.

3 Claims, 4 Drawing Sheets

ARRANGEMENT FOR CLIPPING STRESS PEAKS IN A TURBINE BLADE ROOT

The present invention relates to an arrangement for clipping stress peaks in the anchoring of a turbine blade including a root that is shaped like a Christmas tree, that has tangs, and that is received in a correspondingly-shaped groove in a disk so as to anchor said blade thereto.

BACKGROUND OF THE INVENTION

In one known method of mounting steam turbine blades on a rotor disk, each blade is provided at its base with a foot or a root for anchoring it to the rotor disk. The shape of the root can be likened to a Christmas tree, and the envelope of its outline forms an isosceles trapezium having its large base closer to the base of the blade, and its small base further therefrom. Starting from this envelope, the actual outline of the root includes a series of throats that may be referred to as "recesses". The portion of the outline between two recesses may be referred to as a "tang".

There may be 3 to 5 tangs on a single blade root. The rotor disk carries a series of grooves for receiving the blades. Each groove has an outline that is complementary to the "Christmas-tree" outline of the roots of the blades.

When the turbine rotates, it is these tangs, together with the complementary tangs in the grooves provided in the disk, that retain the blades. A stress field is therefore generated in the root and in the disk along the tangs.

A mean stress exists along each tang but the stress is not constant along the tang, so there exist stress peaks.

OBJECTS AND SUMMARY OF THE INVENTION

An object of the present invention is to reduce such stress peaks.

To this end, the invention provides an arrangement for clipping stress peaks in the anchoring of a turbine blade including a root that is shaped like a Christmas tree, that includes tangs, and that is received in a correspondingly-shaped groove in a disk so as to anchor said blade thereto, wherein the outline of each tang, on the extrados side of the blade root, is such that the clearance for mounting the root in its groove, on the extrados side, is not uniform but rather it includes at least one zone in which the clearance varies, said zone corresponding to a zone of the tang in question where, if the disk-and-blade assembly were rotating at its rated speed of rotation, there would otherwise occur a stress peak relative to the mean stress along the tang if the blade were mounted with constant clearance along the entire length of said tang, said varying clearance varying along a said zone with the same sign as said stress peak.

In a particular embodiment, said zone is situated at the trailing edge. This means that, during machining of the tangs on the root, each tang is machined more deeply in said zone, e.g. by modifying the angle of the path of the milling cutter for a rectilinear root, or by reducing the radius of curvature of the path of the milling cutter for curved root.

Such a tang outline, forming a zone where clearance varies, may also be provided at the leading edge of the blade.

BRIEF DESCRIPTION OF THE DRAWINGS

An embodiment of the invention is described below with reference to the accompanying drawings, in which.

DETAILED DESCRIPTION OF THE INVENTION

Figure 1:
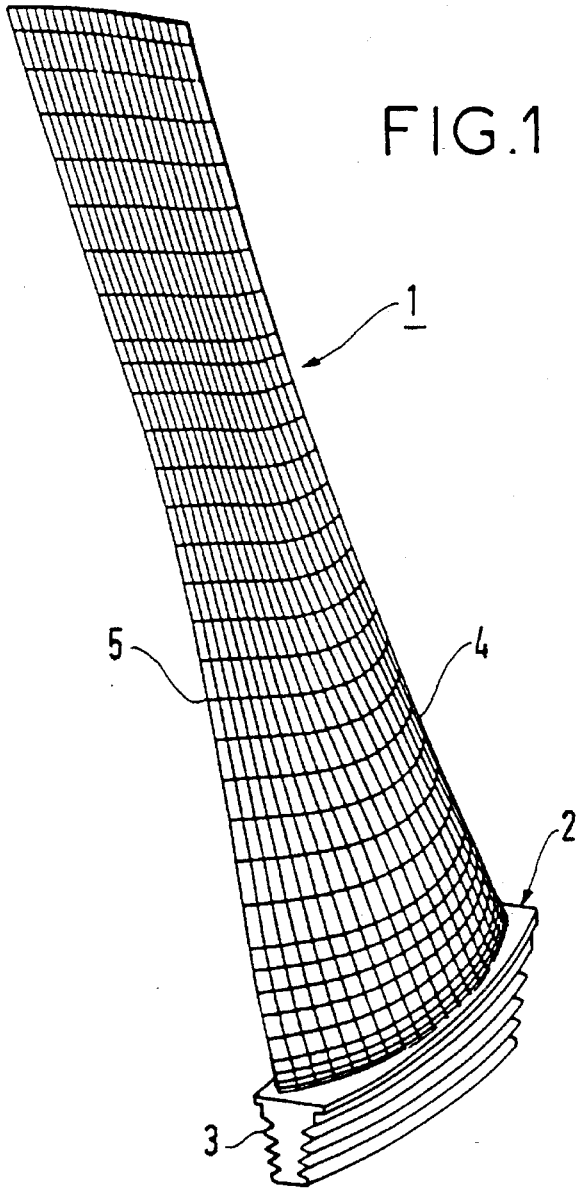
FIG. 1 shows a turbine blade including a root shaped liked a Christmas tree.

FIG. 1 shows a steam turbine blade 1 including a root 2 shaped like a Christmas tree and including a plurality of tangs such as 3. The blade includes a leading edge 4 via which the steam enters, and a trailing edge 5.

The blades, such as 1, are inserted via their roots 2 into grooves of complementary geometrical shape provided in a rotor disk of the turbine.

Figure 2:
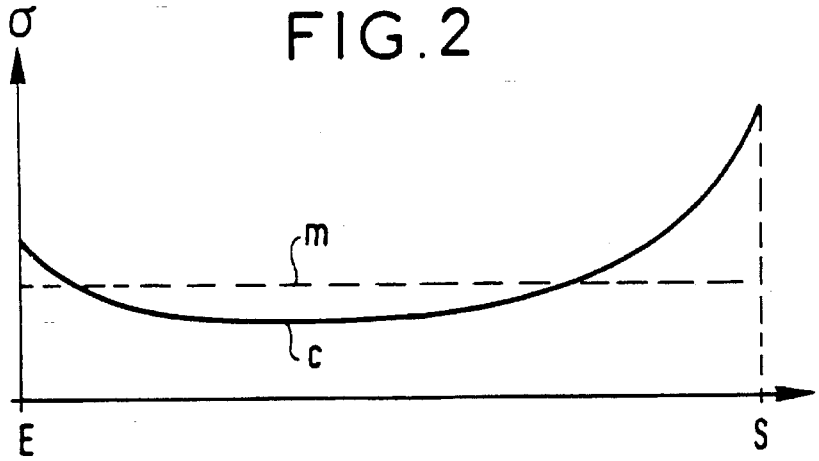
FIG. 2 shows the stress along a tang of a root shaped liked a Christmas tree while the turbine is rotating under rated conditions, and in the absence of the arrangement of the present invention.

FIG. 2 shows the curve c of the stress that exists, while the disk is rotating under rated conditions, along a tang of the root of the blade between the edge E corresponding to the leading edge of the blade, and the edge S corresponding to its trailing edge.

The mean stress m is represented by a dashed line.

This curve shows that there is a high stress peak on the edge S corresponding to the trailing edge of the blade.

The arrangement of the invention enabling such a peak to be clipped is described below with reference to FIGS. 3 and 4.

Figure 3:
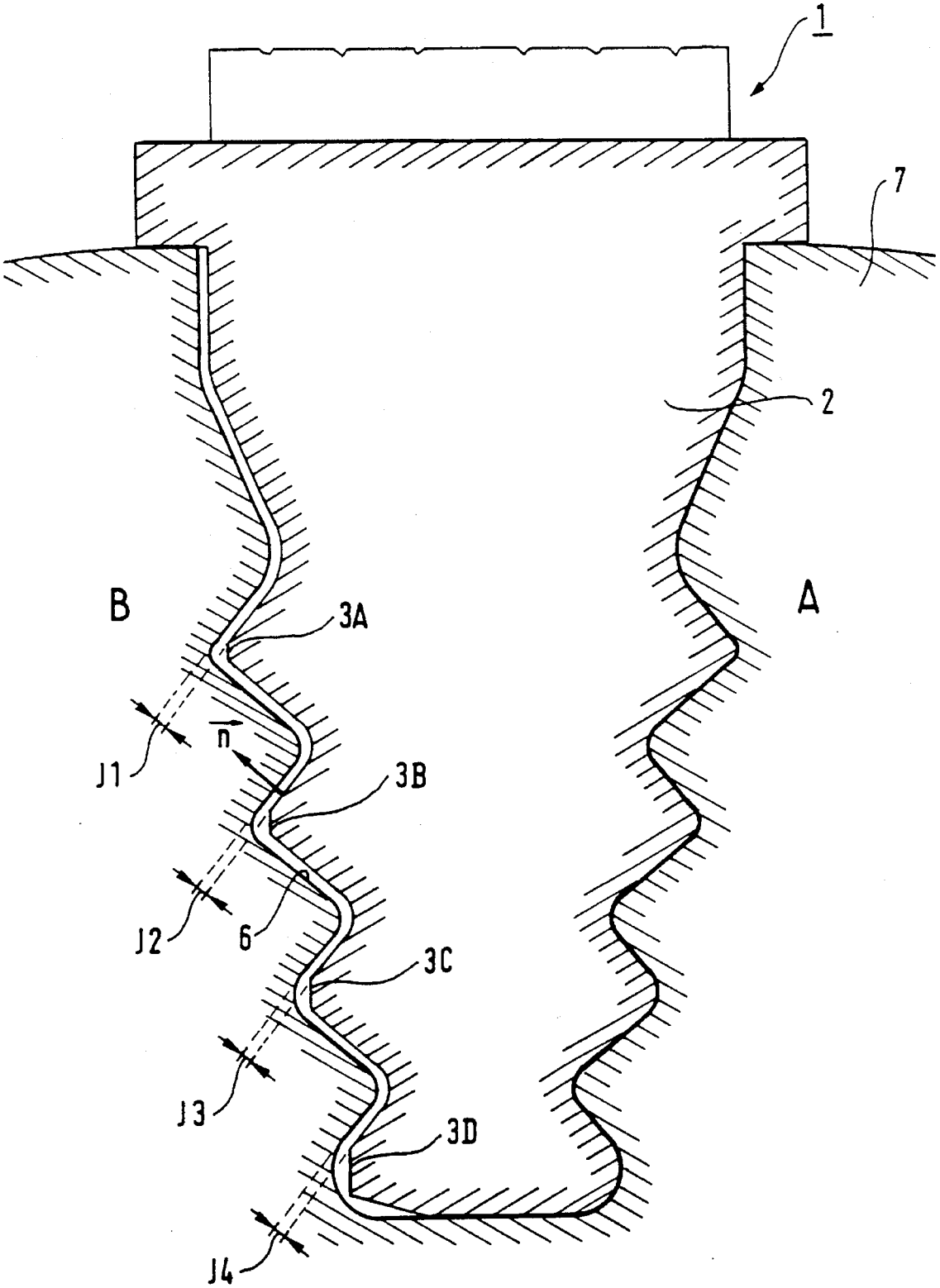
FIG. 3 is a view showing the arrangement of the invention; the view is a diagrammatic fragmentary view on a section that is parallel to the plane of the disk in which the blades are anchored and that is taken through the root at its edge corresponding to the trailing edge of the blade.

FIG. 3 shows the root 2 of a blade 1 in a groove 6 in the rotor disk 7 of a turbine. The side referenced A corresponds to the intrados side, and the side referenced B corresponds to the extrados side. The root of the blade shown includes four tangs 3A, 3B, 3C, and 3D.

FIG. 3 shows the root in section on a plane that is perpendicular to the axis of the disk 7, and on that edge of the root which corresponds to the trailing edge of the blade, i.e. where a peak stress usually occurs in the tangs. The plane corresponding to the section through the root 2 as shown in FIG. 3 is represented by the line referenced 8 in FIG. 4.

On the extrados side, and at this level along the root, clearance J1, J2, J3, & J4 is visible between each tang 3A, 3B, 3C, & 3D and the corresponding wall of the groove 6.

Figure 4:
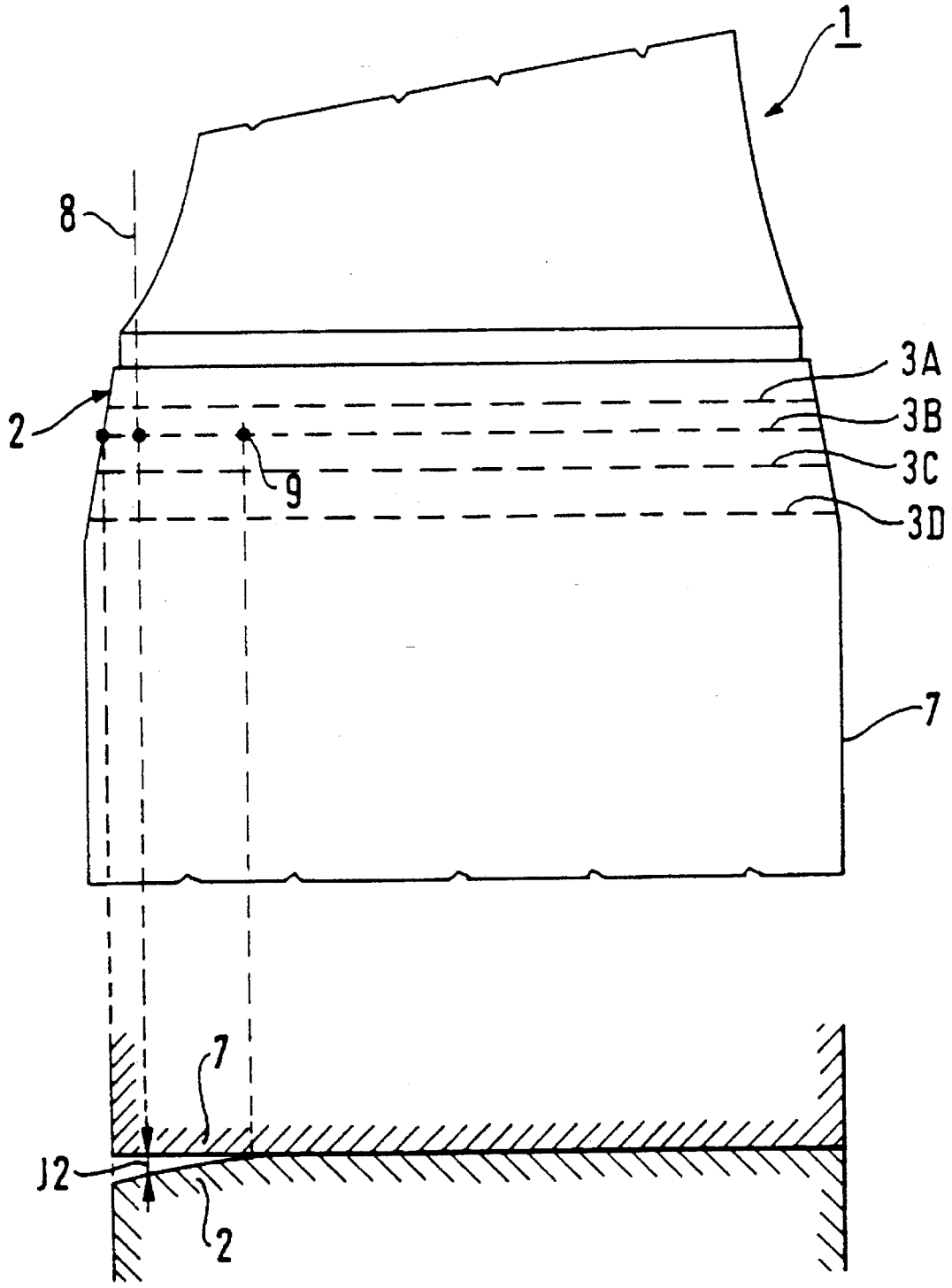
FIG. 4 is a diagrammatic view showing a blade seen perpendicularly to the plane of the disk, with a diagram underneath showing, for one tang, the variation in the clearance between the tang and the corresponding wall of the groove at the trailing edge.

This clearance does not exist along the entire length of each tang, as shown in FIG. 4. Below a diagrammatic view of the root of the blade shown with its tangs, seen perpendicularly to FIG. 3, FIG. 4 includes a diagram representing the variation in the clearance J2 in the direction indicated by $\bar{n}$ (FIG. 3), along the tang 3B.

It can be seen that the clearance J2 varies with the same sign as the stress peak (FIG. 2), i.e. the clearance increases going towards the trailing edge.

Figure 5:
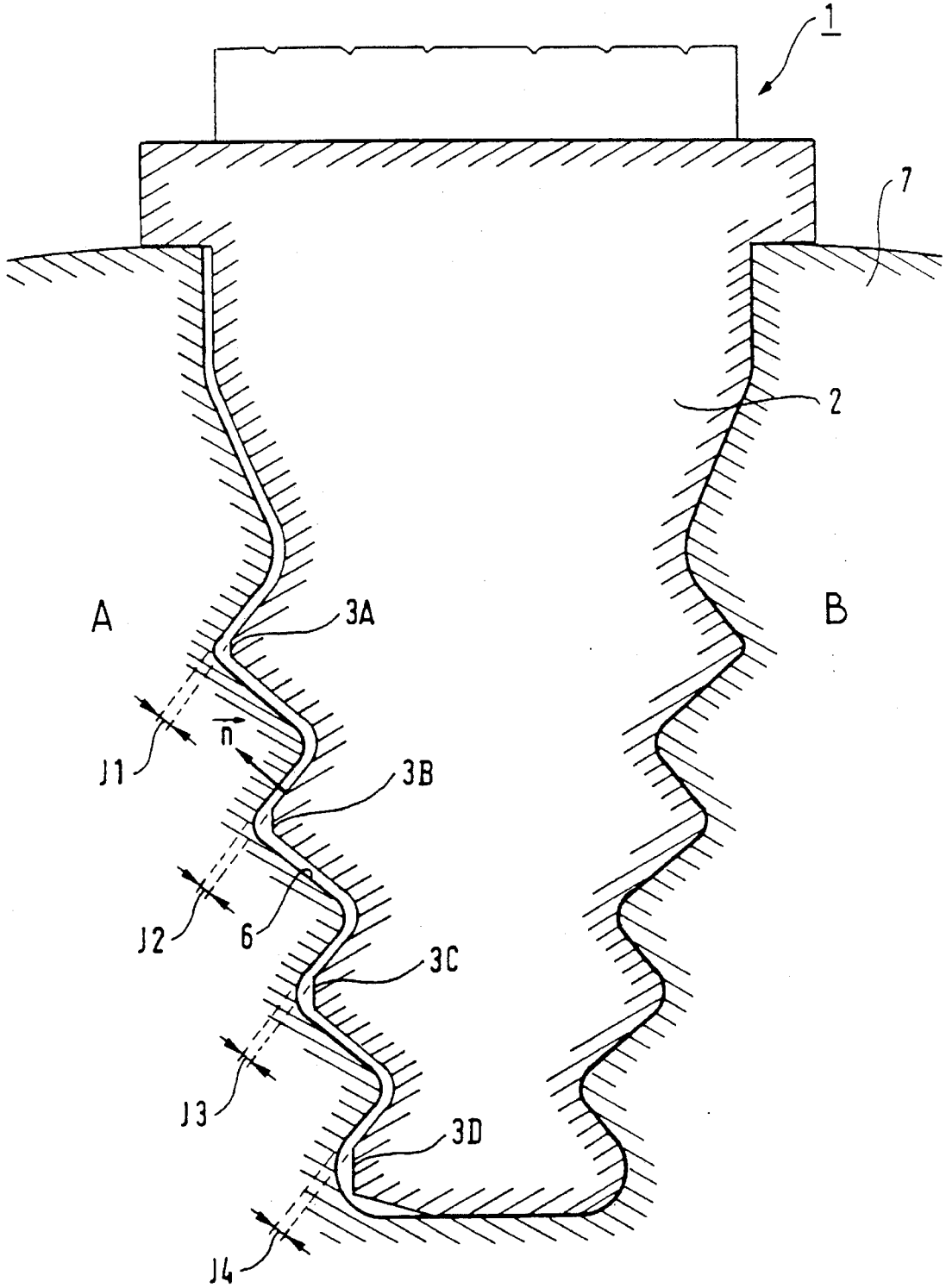
FIG. 5 is a view similar to FIG. 3 but shown an alternative embodiment wherein the zone in which the clearance varies is situated at the leading edge of the turbine blade.

If necessary, if there is a stress peak that is too high on the edge corresponding to the leading edge of the blade, the same measures may be taken on that side (see FIG. 5 where line elements are denoted by like reference numerals).

To obtain said clearance, action is taken while the outlines of the tangs are being machined. For example, in the common case of a curved blade foot, as shown in FIG. 1, it is possible, starting from the point referenced 9 in FIG. 4, to modify (decrease) the radius of the path of the milling cutter used to machine the tangs, so as to remove more material. In the case of a rectilinear foot, the angle of the path is modified, for example.

I claim:

1. An arrangement for clipping stress peaks in the anchoring of a turbine blade defining a leading edge and a trailing edge and including a root that is shaped like a Christmas tree and which defines an extrados side and an intrados side, that includes tangs, and that is received in a correspondingly-shaped groove in a disk so as to anchor said turbine blade thereto, wherein each tang has an outline, on the extrados side of the root, such that a clearance for mounting the root in the groove, on the extrados side, is non-uniform so as to include at least one zone in which the clearance varies, said at least one zone corresponding to a zone of the tang where, when the disk-and-blade assembly is rotating at its rated speed of rotation, there would otherwise occur a stress peak relative to a mean stress along the tang when the turbine blade is mounted with a constant clearance along the entire length of the tang, said varying clearance varying along said at least one zone with the same sign as said stress peak.

2. The arrangement according to claim 1, wherein said at least one zone is situated at the trailing edge of the turbine blade.

3. The arrangement according to claim 1, wherein said at least one zone is situated at the leading edge of the turbine blade.

* * * * *